US011353169B2

(12) United States Patent
DeVol et al.

(10) Patent No.: US 11,353,169 B2
(45) Date of Patent: Jun. 7, 2022

(54) SYSTEMS AND METHODS FOR ASSEMBLING A LIGHT ENGINE

(71) Applicant: Hubbell Lighting, Inc, Shelton, CT (US)

(72) Inventors: Nathaniel DeVol, Greenville, SC (US); Brien Housand, Pensacola, FL (US)

(73) Assignee: Hubbell Lighting, Inc., Shelton, CT (US)

( * ) Notice: Subject to any disclaimer, the term of this patent is extended or adjusted under 35 U.S.C. 154(b) by 232 days.

(21) Appl. No.: 16/401,878

(22) Filed: May 2, 2019

(65) Prior Publication Data

US 2019/0338899 A1 Nov. 7, 2019

Related U.S. Application Data

(60) Provisional application No. 62/665,793, filed on May 2, 2018.

(51) Int. Cl.

| | |
|---|---|
| ***F21V 5/04*** | (2006.01) |
| ***F21K 9/90*** | (2016.01) |
| ***F21K 9/68*** | (2016.01) |
| ***F21V 19/00*** | (2006.01) |
| *F21Y 113/13* | (2016.01) |
| *F21Y 115/10* | (2016.01) |
| *F21Y 105/18* | (2016.01) |

(52) U.S. Cl.
CPC ..... *F21K 9/90* (2013.01); *F21K 9/68* (2016.08); *F21V 19/003* (2013.01); *F21Y 2105/18* (2016.08); *F21Y 2113/13* (2016.08); *F21Y 2115/10* (2016.08)

(58) Field of Classification Search
None
See application file for complete search history.

(56) References Cited

U.S. PATENT DOCUMENTS

2011/0170289 A1* 7/2011 Allen ..... F21K 9/60 362/235
2013/0051045 A1* 2/2013 Kay ..... F21S 41/265 362/478

* cited by examiner

*Primary Examiner* — Elmito Breval
(74) *Attorney, Agent, or Firm* — Michael Best & Friedrich LLP

(57) ABSTRACT

A system and method of assembling a light engine includes determining a desired light output profile for the light engine, selecting a reflector based on the desired light output profile, and selecting one of a first light board and a second light board. The first light board includes a different number of light emitting diodes than the second light board. Each of the first light board and the second light board are capable of providing the desired output light profile when they are coupled with the selected reflector. The method also includes positioning the one of the first light board and the second light board within the housing, adjacent the reflector.

6 Claims, 9 Drawing Sheets

SYSTEMS AND METHODS FOR ASSEMBLING A LIGHT ENGINE

CROSS-REFERENCE TO RELATED APPLICATION

This application claims priority to U.S. Application No. 62/665,793, filed May 2, 2018, the entire contents of which are incorporated herein by reference.

BACKGROUND

The present disclosure relates to a light engine and, more specifically, to systems and methods for assembling a light engine.

SUMMARY

In one embodiment, a method of assembling a light engine includes determining a desired light output profile for the light engine, selecting a reflector based on the desired light output profile, and selecting one of a first light board and a second light board. The first light board includes a different number of light emitting diodes than the second light board. Each of the first light board and the second light board are capable of providing the desired output light profile when they are coupled with the selected reflector. The method also includes positioning the one of the first light board and the second light board within the housing, adjacent the reflector.

In another embodiment, a method of assembling a light engine, the method comprising providing a first light board having light emitting diodes and providing a second light board having a different number of light emitting diodes than the first light board. The method further includes determining a desired output light profile for the light engine, selecting a reflector based on the desired output light profile, selecting one of the first light board and the second light board. Each of the first light board and the second light board are capable of providing the desired output light profile when they are coupled with the selected reflector. The method further including positioning the one of the first light board and the second light board adjacent the reflector.

In yet another embodiment, a system for assembling a light engine includes a plurality of light boards and a reflector capable of being selectively paired with any one of the plurality of light boards. Each of the light boards provides a light output that has a different luminous flux compared to the others. The reflector provides a light output with the same beam angle regardless of which one of the lights boards is selected.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In general, the present disclosure relates to a system and a method for assembling a light engine including selecting one a plurality of light boards to pair with an optic member, such as a reflector. Although the light boards have different numbers of light emitting elements and therefore different luminous fluxes, each of the boards produces substantially the same beam shape and beam angle when paired with the selected optic member.

Figure 1:
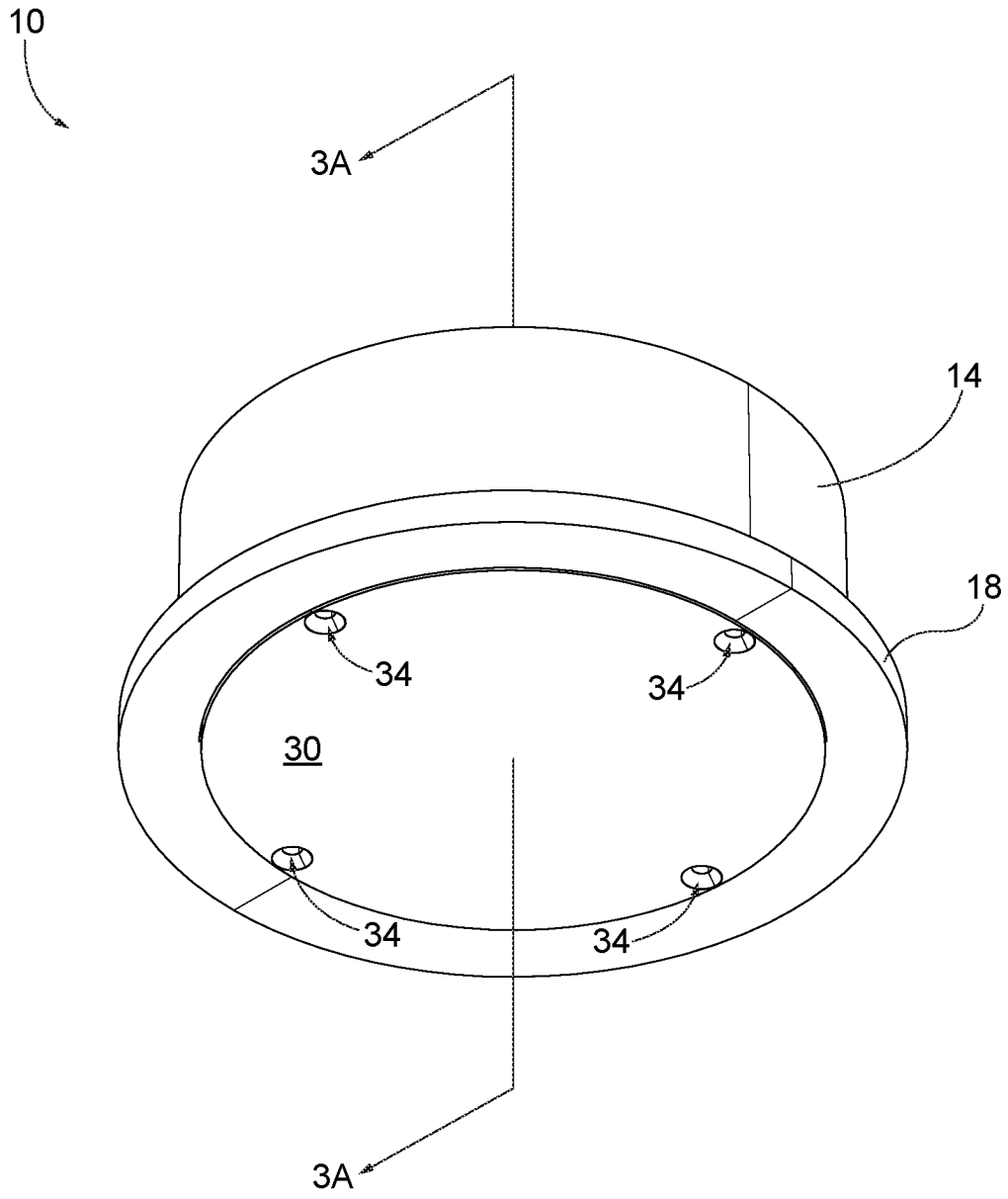
FIG. 1 is a perspective view of a luminaire.

As shown in FIG. 1, a luminaire 10 includes a housing 14 and a flange or lip 18. In the illustrated embodiment, the housing 14 and the lip 18 are cylindrical in shape. The lip 18 includes a diameter larger than a diameter of the housing 14. In the illustrated embodiment, the luminaire 10 includes a light engine that is configurable to be positioned within various luminaires (not shown). The housing 14 is configured to support the light engine and the lip 18 is configured to abut against a mounting surface.

Figure 2A:
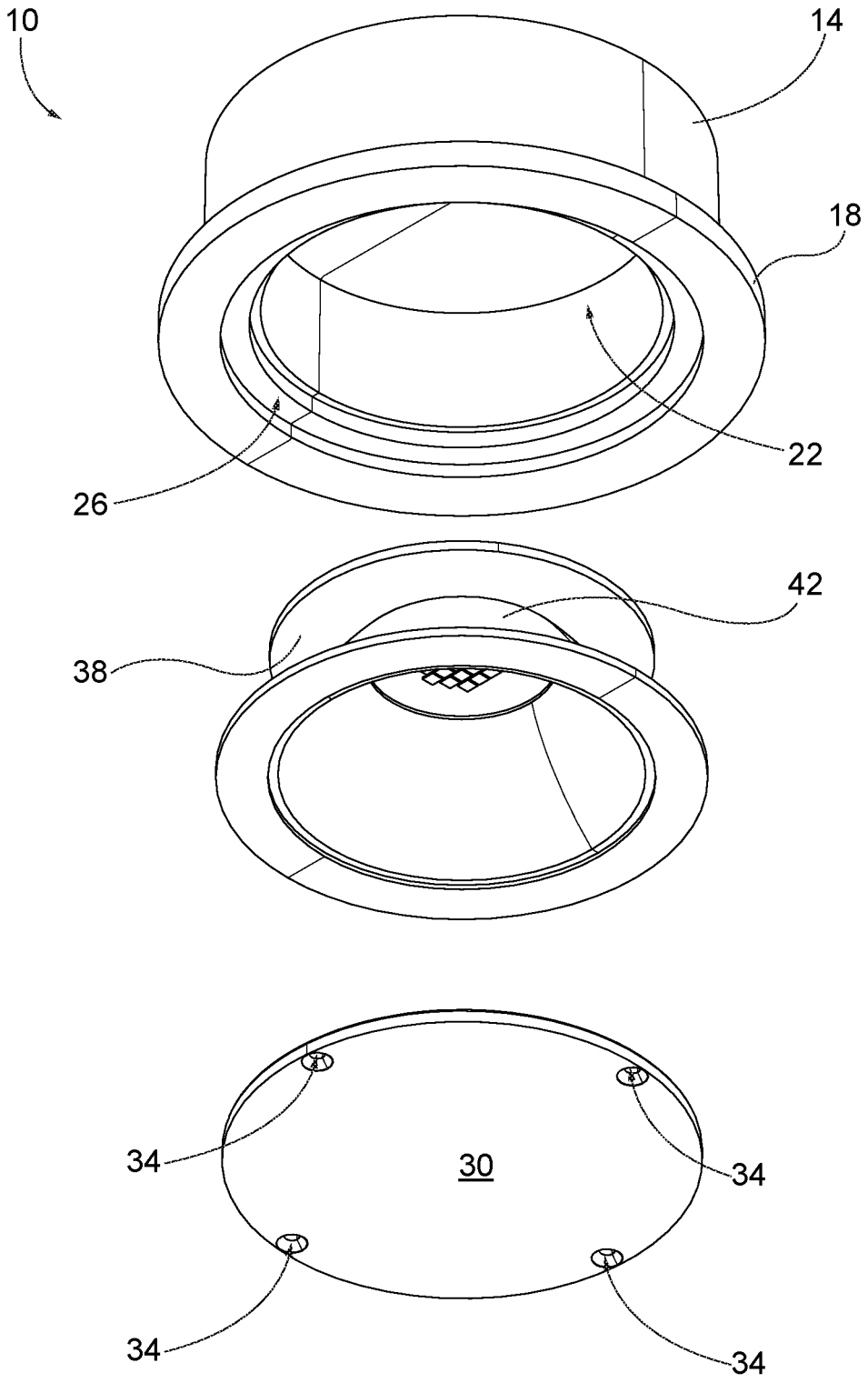
FIG. 2A is an exploded view of the luminaire of FIG. 1.

As shown in FIG. 2A, the housing includes a cavity 22 and the lip 18 includes an opening 26 that provides communication between an external environment and the cavity 22. A lens 30 is receiveable within the opening 26. The lens 30 includes fastening apertures 34 that are configured to receive fastening members (e.g., threaded screws—not shown). The fastening members removably couple the lens 30 to the housing 14. In the illustrated embodiment, the lens 30 is substantially flush with the lip 18 (FIG. 1), which allows the lens 30 to be easily removed from the housing 14 while the light engine 10 is positioned within the luminaire.

Figure 3A:
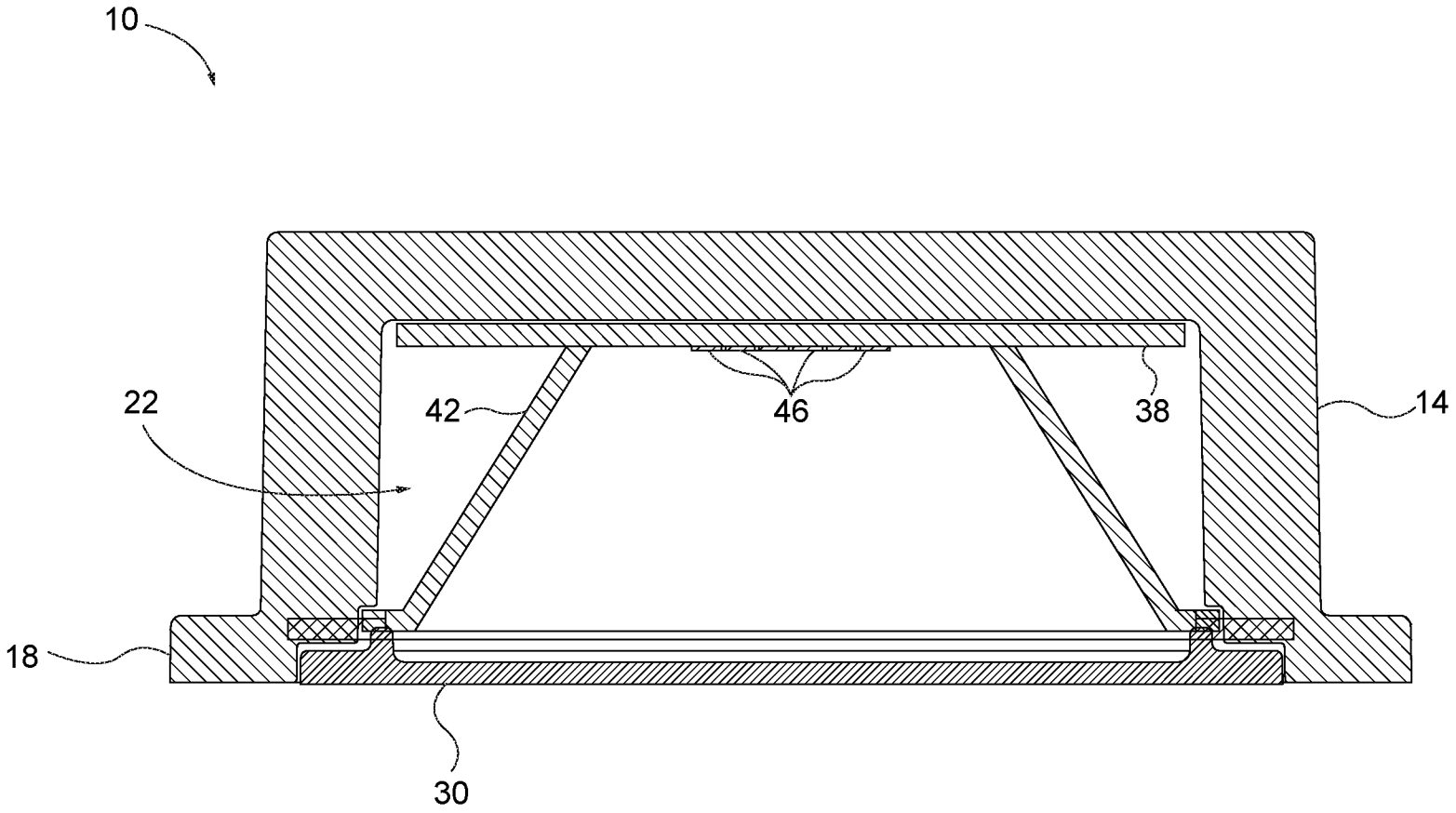
FIG. 3A is a cross-sectional view of the luminaire of FIG. 1, viewed along the 3A-3A line.

As shown in FIG. 3A, the light engine 10 also includes a light board 38 and a reflector 42. Light emitting elements 46 are disposed on the light board 38. In the illustrated embodiment, the light emitting elements 46 are light emitting diodes (LEDs). The LEDs 46 are electrically connected to light board 38, which is electrically connected to a current supply (e.g., a DC driver—not shown). The light board 38 is coupled to the housing 14 at an end of the cavity 22. The LEDs 46 are oriented toward the opening 26.

Figure 10:
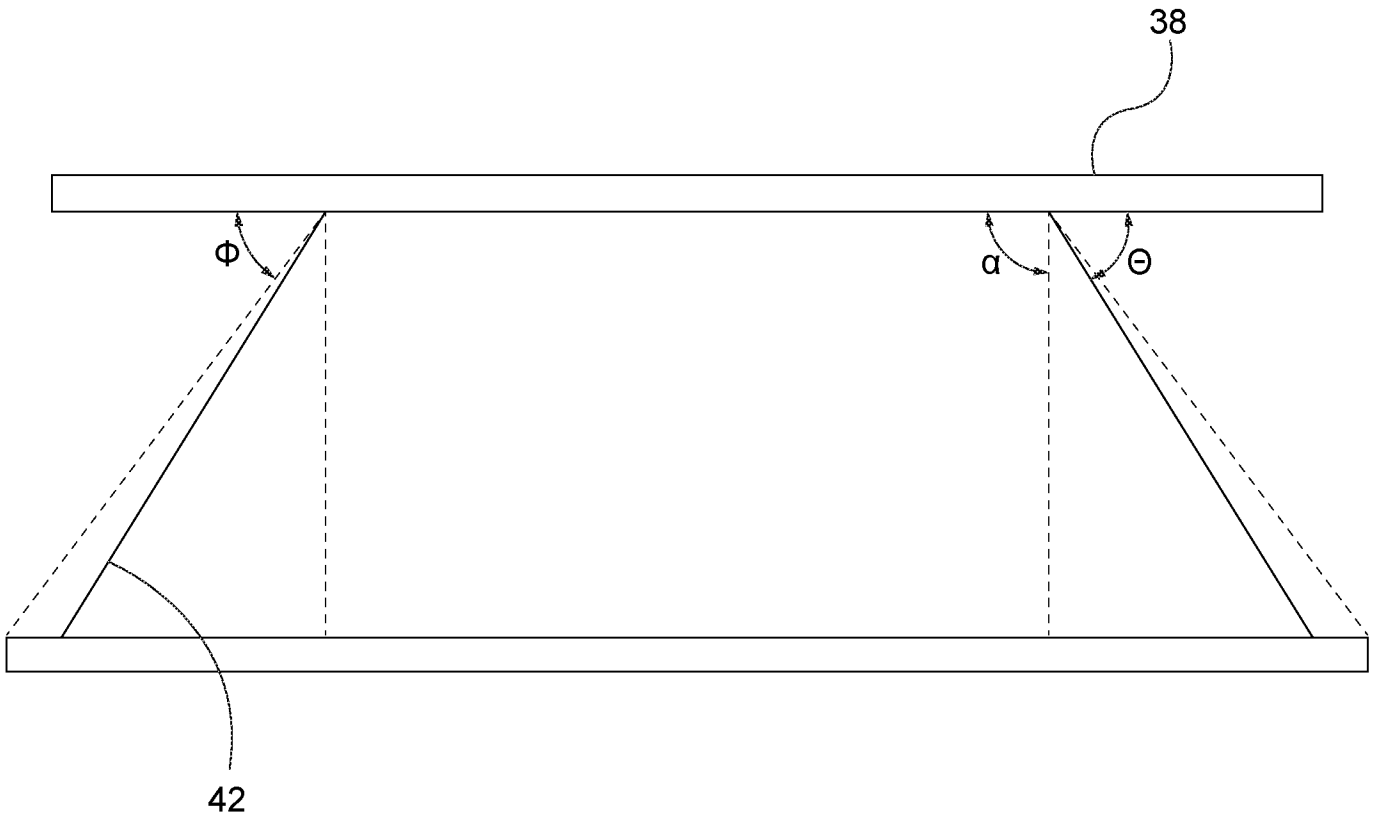
FIG. 10 is a side view of the reflector of FIG. 4, illustrating different reflector angles.

The reflector 42 is coupled to the light board 38. The reflector 42 also includes a central opening 50 (FIG. 10) that is positioned around the LEDs 46 so as not to cover any of the LEDs 46. In the illustrated embodiment, sides of the reflector 42 are oriented at an angle θ, which is approximately 60° with respect to the light board 38 and has a straight cross section; although in other embodiments, sides of the reflector 42 may be oriented at other angles and/or have different cross sections (e.g., parabolic). For example, sides of the reflector 42 may be oriented at an angle φ that is less than the angle θ (e.g., φ may be as small as approximately 25°), or at an angle α that is greater than the angle θ (e.g., α may be as large as approximately 90°) (FIG. 10). Different angled reflectors 42 create different light beam profiles (e.g., a shape of the beam, an angle of the beam, etc.). Different surface properties (e.g., surface roughness) of the reflector 42 can also be used to change the beam shape.

Figure 2B:
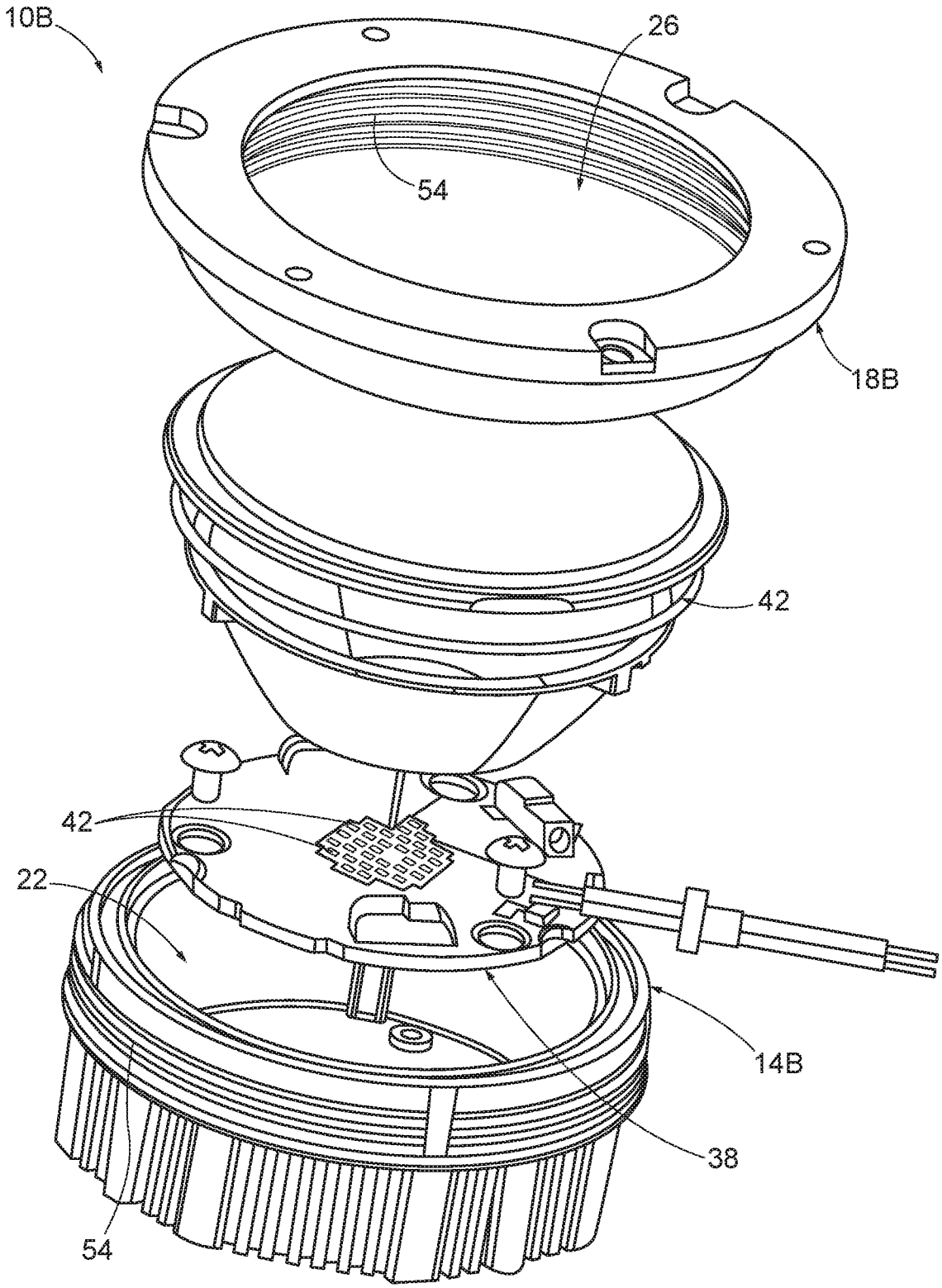
FIG. 2B is an exploded view of a luminaire according to another embodiment.
Figure 3B:
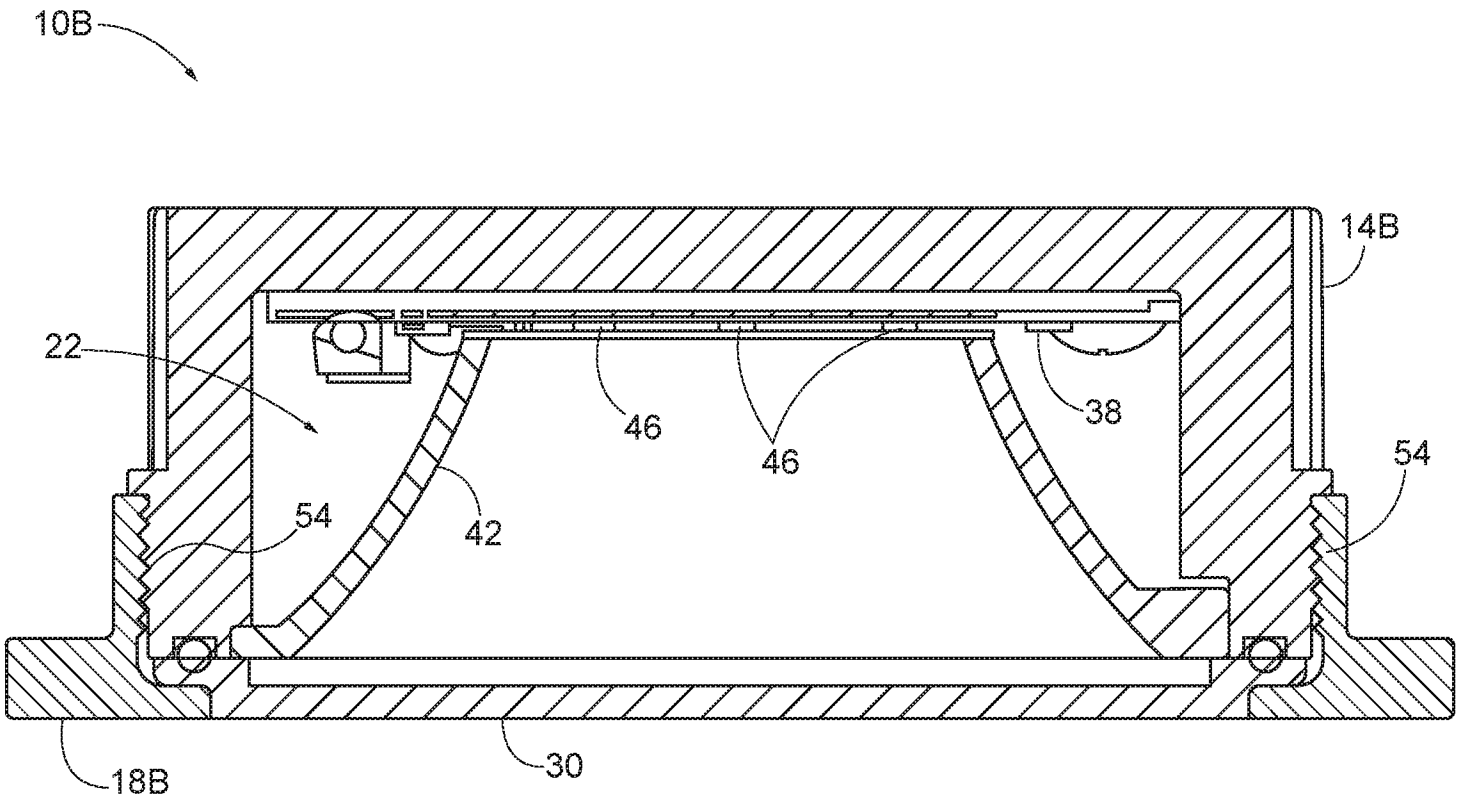
FIG. 3B is a cross-sectional view of the luminaire of FIG. 2B.

FIGS. 2B and 3B illustrate a luminaire 10B according to another embodiment. The luminaire 10B includes a housing 14B and a lip 18B formed as separate pieces. Both the housing 14B and the lip 18B have threaded sections 54 that are engageable with one another in order to removably couple the lip 18B to the housing 14B without the need for additional fasteners (e.g., threaded screws). A user may rotate the lip 18B with respect to the housing 14B in order to couple the lip 18B and the housing 14B together. In the illustrated embodiment, the lip 18B is wider than the housing 14B.

Figure 4:
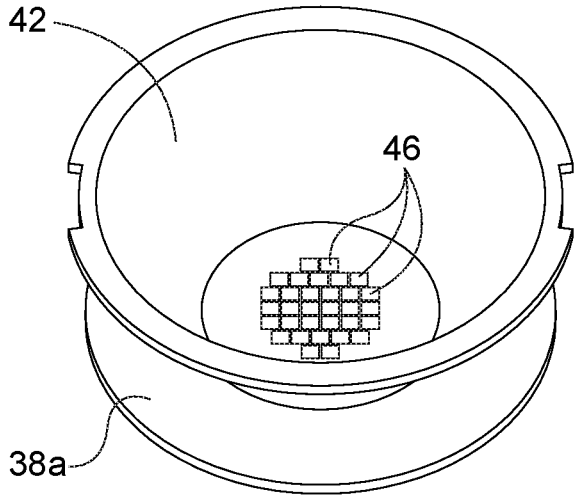
FIG. 4 is a perspective view of a reflector coupled to a first light board.
Figure 5:
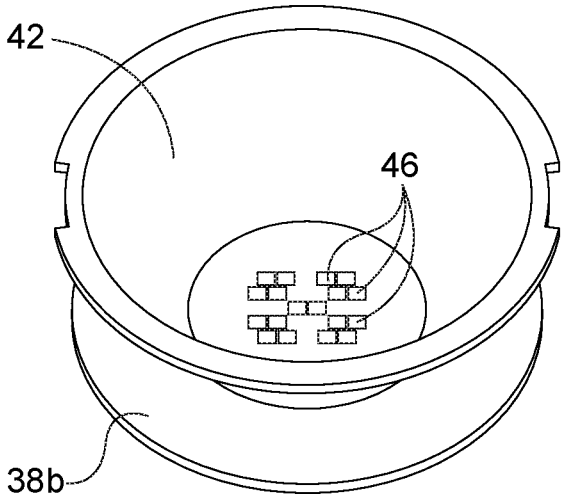
FIG. 5 is a perspective view of the reflector of FIG. 4, coupled to a second light board.
Figure 6:
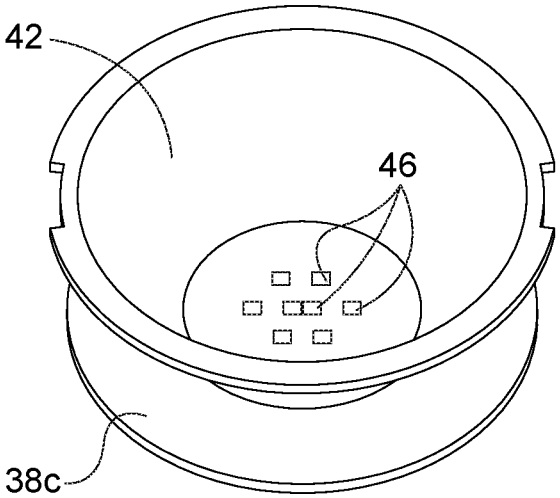
FIG. 6 is a perspective view of the reflector of FIG. 4, coupled to a third light board.

As illustrated in FIGS. 4-6, different light boards 38 can be couple to the housing (FIG. 3) and used with the same reflector 42. The different light boards 38 have a different number of LEDs 46, and the LEDs 46 are arranged in different patterns.

As shown in FIG. 4, a first light board 38*a* includes LEDs 46 arranged in a first pattern. In the illustrated embodiment, the LEDs 46 are arranged in a substantially octagonal shape; although in other embodiments the LEDs 46 may be arranged in another polygonal shape. The LEDs 46 are arranged to define a source extent or outer perimeter of the octagon, as well as to fully define an internal area of the octagon. In total, thirty-two LEDs 46 are used to form the octagon. In the illustrated embodiments, the LEDs 46 are arranged in closely packed rows and columns so that every LED 46 is adjacent to at least three other LEDs. 46. The octagon (or other polygonal shape) has a center each LED 46 is spaced apart from the center by a distance, and the LEDs 46 collectively define an average LED distance to the center. Stated another way, distances from a center of each LED to the center of the polygonal shape are measured and an average of the measured distances is calculated.

As shown in FIG. 5, a second light board 38*b* includes LEDs 46 arranged in a second pattern. In the illustrated embodiment, the LEDs 46 on the second light board 38*b* are also arranged in a substantially octagonal pattern, although the second light board 38*b* includes fewer LEDs 46 than the first light board 38*a* (i.e., the second light board 38*b* includes fewer than thirty-two LEDs 46). The second pattern resembles the first pattern, but various LEDs 46, which are present in the first pattern, are absent from the second pattern. The LEDs 46 in the second pattern are arranged to have a substantially similar source extent as the octagonal shape of the first pattern, but the second pattern includes fewer LEDs 46 within an internal area. Thus, the internal area of the second pattern is not completely filled with LEDs 46, and every LED 46 on the second light board 38*b* is not adjacent at least three other LEDs 46. The LEDs 46 are selectively removed from the light board 38*a*-38*c* so that the average LED distance to center remains consistent (i.e., the average LED distance to center in the second pattern is substantially the same as the average LED distance to center in the first pattern). In some embodiments, a beam angle and average LED distance to center are directly correlated, so maintaining the average LED distance to center maintains a consistent the beam angle.

As shown in FIG. 6, a third light board 38*c* includes LEDs 46 arranged in a third pattern. In the illustrated embodiment, the LEDs 46 on the third light board 38*c* are also arranged in a substantially octagonal pattern, although the third light board 38*c* includes fewer LEDs 46 than the second light board 38*b*. The third pattern resembles the first and second patterns, but various LEDs 46 are absent from the third pattern, which are present in the first and second patterns. The LEDs 46 in the third pattern are arranged to have a substantially similar outer perimeter as the octagonal shape of the first and second patterns, but the third pattern includes fewer LEDs 46 within an internal area. Thus, the internal area of the third pattern is not completely filled with LEDs 46, and every LED 46 on the third light board 38*c* is not adjacent at least two other LEDs 46. The LEDs 46 are selectively removed from the light board 38*a*-38*c* so that the average LED distance to center remains consistent (i.e., the average LED distance to center in the third pattern is substantially the same as the average LED distance to center in the first and second patterns).

Figure 9:
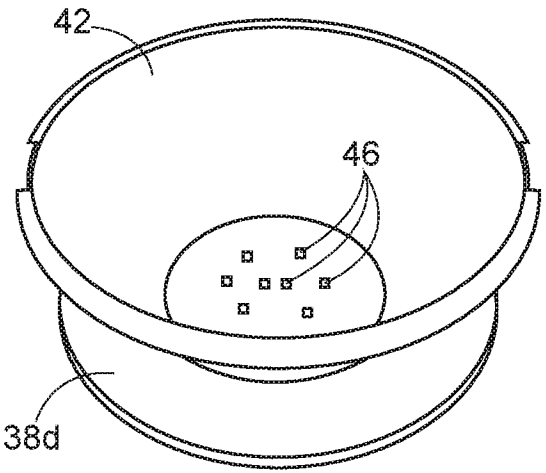
FIG. 9 is a perspective view of the reflector of FIG. 7, coupled to a sixth light board.
Figure 8:
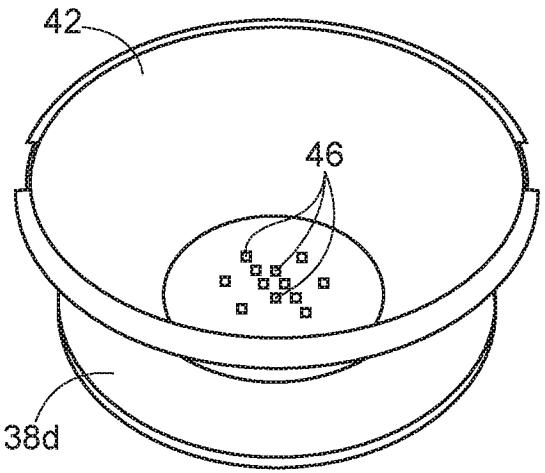
FIG. 8 is a perspective view of the reflector of FIG. 7, coupled to a fifth light board.
Figure 7:
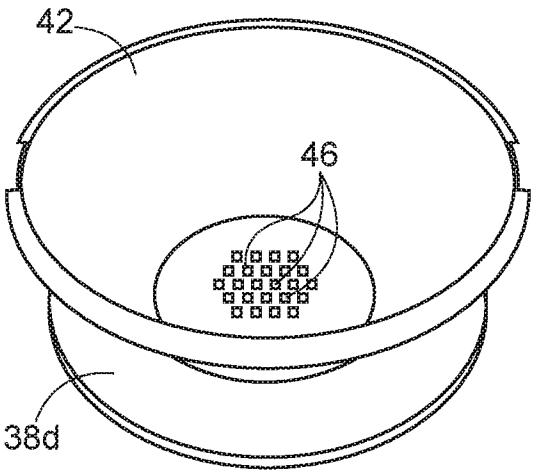
FIG. 7 is a perspective view of another reflector coupled to a fourth light board.

FIGS. 7-9 illustrate additional embodiments of light boards 38*d*-38*f*. The fourth light board 38*d*, the fifth light board 38*e*, and the sixth light board 38*f* are substantially similar to the first light board 38*a*, the second light board 38*b*, and the third light board 38*c* respectively. The main difference between the fourth-sixth light boards 38*d*-38*f* and the first-third light boards 38*a*-38*c* is that the fourth-sixth light boards 38*d*-38*f* are arranged in a hexagonal shape instead of an octagonal shape. In the illustrated embodiment, the LEDs 46 of the fourth light board 38*d* are arranged to define a source extent or outer perimeter of the hexagon, as well as to fully define an internal area of the hexagon (FIG. 7). In total, twenty-four LEDs 46 are used to form the hexagon. As shown in FIG. 8, the LEDs 46 on the fifth light board 38*e* are also arranged in a substantially hexagonal pattern, although the fifth light board 38*e* includes fewer LEDs 46 than the fourth light board 38*d* (i.e., the fifth light board 38*e* includes fewer than twenty-four LEDs 46). As shown in FIG. 9, the LEDs 46 on the sixth light board 38*f* are also arranged in a substantially hexagonal pattern, although the sixth light board 38*f* includes fewer LEDs 46 than the fifth light board 38*e*. In the illustrated embodiments, the LEDs 46 on the light boards 38*d*-38*f* have substantially the same average LED distance to center.

Figure 12:
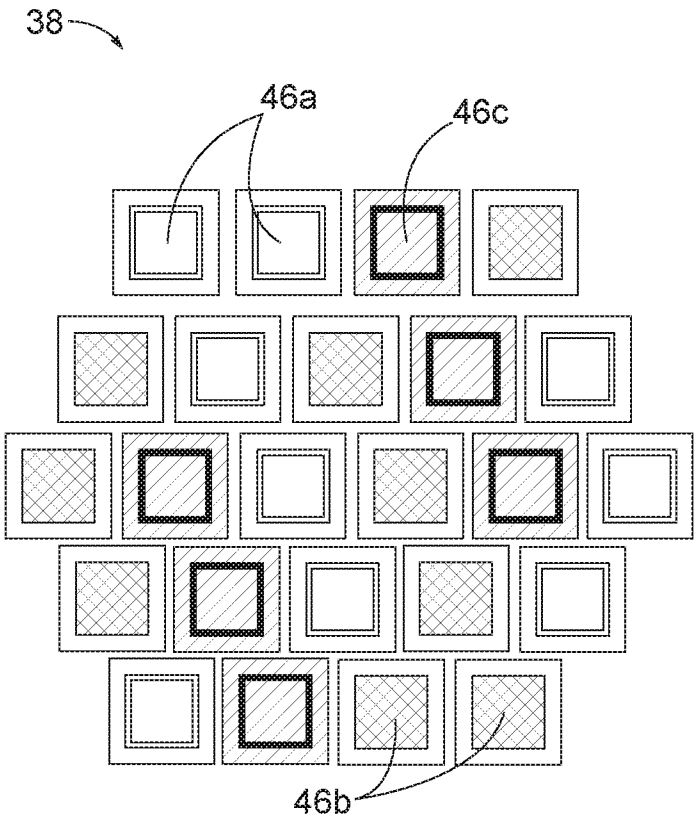
FIG. 12 is a top view of another light board having first color temperature light emitters and second color temperature light emitter arranged in a second configuration.
Figure 11:
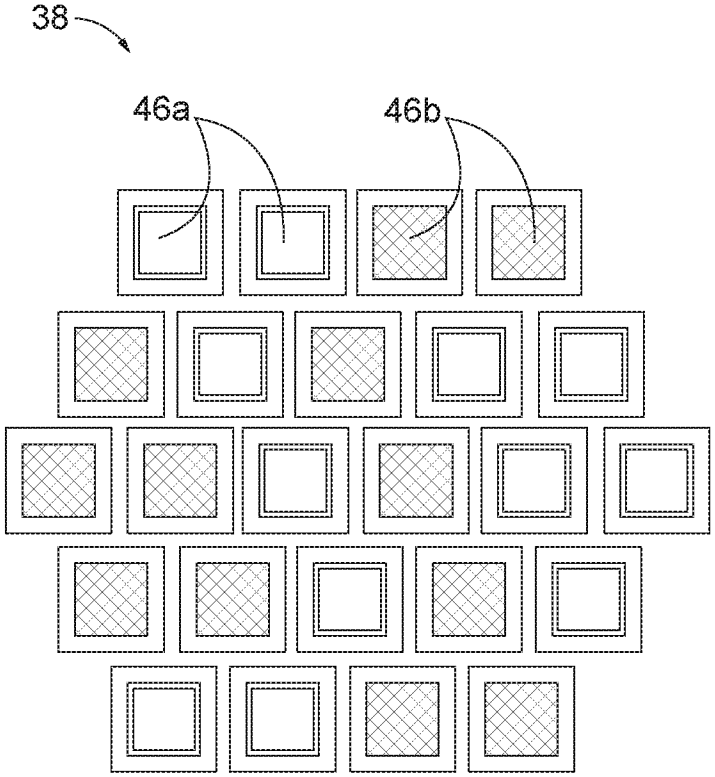
FIG. 11 is a top view of a light board having first color temperature light emitters and second color temperature light emitter arranged in a first configuration.

As shown in FIGS. 11 and 12, some embodiments of the light boards 38*a*-38*f* are made up of first LEDs 46*a* having a first color temperature and second LEDs 46*b* having a second color temperature. A number of first LEDs 46*a* is equivalent to a number of second LEDs 46*b* for each light board 38*a*-38*f*. A pattern of first LEDs 46*a* is rotationally symmetric to a pattern of second LEDs 46*b*. The patterns of first LEDs 46*a* and the pattern of second LEDs 46*b* each approximate the overall perimeter of the polygonal shape. As shown in FIG. 11, the first and second LEDs 46*a*, 46*b* define an outer perimeter of a polygon (i.e., a hexagon), as well as fully define an internal area of the polygon (i.e., similar to the first light board 38*a* (FIG. 4) and the fourth light board 38*d* (FIG. 7)). As shown in FIG. 12, first and second LEDs 46*a*, 46*b* are together arranged to have a substantially similar source extent or outer perimeter as the polygonal shape of the light board 38 in FIG. 11, but the light board 38 of FIG. 12 includes fewer first and second LEDs 46*a*, 46*b* within an internal area. The polygonal shape includes empty spaces 46*c* within the internal area where no first or second LEDs 46*a*, 46*b* are positioned.

The consistent source extent and average LED distance to center of each pattern is responsible for creating the consistent beam profile for the respective light boards 38*a*-38*f* when paired with a common reflector 42. The pattern of the light boards 38*a*-38*f* each approximate the same polygonal shape (e.g., an octagon, a hexagon, etc.), and therefore have the same general perimeter. As illustrated in FIG. 4, the closely packed shape of the first pattern most closely approximates the octagonal shape. As shown in FIGS. 5 and 6, removing LEDs 46 to create the second and third patterns more generally approximate the octagonal shape, but the general source extent remains. In addition to maintaining a constant source extent, LEDs 46 remain at the center of the board 38*a*-38*f* to prevent a hole from appearing in the beam. The common source extent approximations across all of the light boards 38*a*-38*f* and the average LED distance to center create substantially the same beam profile for each of the light boards 38*a*-38*f* when a common reflector is used.

The different number of LEDs 46 on each light board 38*a*-38*f* determines the luminous flux for each light board 38*a*-38*f* (i.e., the total energy of visible light emitted over a period of time). The first light board 38*a*, which includes the greatest number of LEDs 46, has the largest luminous flux, and the third light board 38*c*, which includes the fewest number of LEDs 46, has the smallest luminous flux.

A user may select one of the three light boards 38*a*-38*f* based on desired user characteristics (e.g., brightness, energy consumption, cost, etc.). For example, the first light board 38*a* will tend to be brighter than the second and third light boards 38*b*, 38*c* but will likely consume more energy and cost more because the first light board 38*a* includes more LEDs 46.

After selecting a light board 38*a*-38*f*, the user assembles the light engine 10 by positioning the light board 38*a*-38*f* and the reflector 42 in the cavity 22. Electrical current is supplied to the light board 38*a*-38*f* and the LEDs 46 output visible light. The reflector 42 shapes the visible light and creates an output or light profile, which includes the shape of the light beam (e.g., circular or polygonal), as well as the angle that the light beam projects relative to a light emitting surface (i.e., the light board 38*a*-38*f*).

The user may replace the selected light board 38*a*-38*f* with one of the other light boards 38*a*-38*f* and position the newly selected light board 38*a*-38*f* and the reflector 42 in the cavity 22. Since all three light boards 38*a*-38*f* approximate the same source extent and average LED distance to center, the LEDs 46 of each light board 46 output the same light profile for a given reflector 42.

A user may change the light profile of the light boards 38*a*-38*f* by utilizing a different reflector 42. Different angled/shaped reflectors 42 (FIG. 10), reflect the visible light at different angles and can create different light beam shapes and/or different angles that the light beam projects relative to the light emitting surface 38*a*-38*f*.

A user may also change the overall color of the visible light emitted for the light boards. The selected light board 38*a*-38*f* is tunable (i.e., a user can selectively control the current supplied to the first LEDs 46*a* and the second LEDs 46*b*). The user may tune the light board 38*a*-38*f* to a first state where current is only supplied to the first LEDs 46*a* or a second state where current is only supplied to the second LEDs 46*b*. In the first state, the user observes visible light with the first color temperature and in the second state, the user observes visible light with the second color temperature. The user may also tune the light board 38*a*-38*f* to a third state between the first state and the second state. In the third state, current is supplied to both the first LEDs 46*a* and the second LEDs 46*b*, and the user observes visible light as a mix of the first color temperature and the second color temperature. Placing the LEDs 46*a*, 46*b* on the light board 38*a*-38*f* with a consistent source extent and a consistent average LED distance to center allows the beam shape to remain relatively constant in all three states.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

What is claimed is:

1. A system for assembling a light engine, the system comprising:

a plurality of light boards, each of the light boards including a plurality of light emitting diodes, each of the light boards providing a light output having a different luminous flux compared to the other light boards; and a reflector capable of being selectively paired with any one of the plurality of light boards, the reflector providing a light output having the same beam angle regardless of which one of the lights boards is selected.

2. The system of claim 1, wherein a first portion of the light emitting diodes of one of the plurality of light boards emits light at a first color temperature and a second portion of the one of the plurality of light boards emits light at a second color temperature, wherein positioning the light emitting diodes includes positioning the first portion of the light emitting diodes in an arrangement that is rotationally symmetric to the second portion of the light emitting diodes.

3. The system of claim 1, further comprising the plurality of light emitting diodes of a first light board of the plurality of light boards being symmetric about a plane of symmetry with respect to the first light board, the plurality of light emitting diodes of a second light board of the plurality of light boards being symmetric about the same plane of symmetry with respect to the second light board.

4. The system of claim 1, wherein the plurality of light emitting diodes on each of the plurality of light boards are positioned to approximate substantially the same polygon.

5. The system of claim 4, wherein the polygon is one of a hexagon and an octagon.

6. The system of claim 1, wherein an average LED distance to center is substantially the same for each of the plurality of light boards.

* * * * *